US005252101A

United States Patent [19]

Rosenwinkel et al.

[11] Patent Number: 5,252,101

[45] Date of Patent: Oct. 12, 1993

[54] SIMULATED TOY COMMODE

[75] Inventors: Donald A. Rosenwinkel, Oak Park; Richard B. Kuralt, Chicago, both of Ill.

[73] Assignee: Breslow, Morrison, Terzian & Associates, Inc., Chicago, Ill.

[21] Appl. No.: 825,149

[22] Filed: Jan. 24, 1992

[51] Int. Cl.[5] ..... A63H 3/52; A63H 33/00

[52] U.S. Cl. ..... 446/130; 446/267; 446/479

[58] Field of Search ..... 446/130, 267, 479, 482, 446/481, 472, 296

[56] References Cited

U.S. PATENT DOCUMENTS 3,842,531 10/1974 Sloan ..... 446/267
4,285,156 8/1981 Leistikow et al. ..... 446/479
4,938,730 7/1990 Yamane et al. ..... 446/130

*Primary Examiner*—Mickey Yu
*Attorney, Agent, or Firm*—Dick and Harris

[57] ABSTRACT

An simulated toy commode or potty for dolls including a removeable vessel having clear spaced apart walls defining an annular space. Similar reservoirs are mounted above and below the annular and are in controlled fluid communication with the annular space. A predetermined volume of liquid wholly containable in any one of the annular space or either reservoir is sealed within the vessel. Similar valves control the flow of the liquid between each of the reservoirs and the annular space. The vessel is removeably positionable in a housing that includes a hinged seat carrying an actuator for the upper one of the reservoirs so that upon downward movement of the seat the upper reservoir is emptied into the annular space. A flushing lever carried by the housing is linked to an actuator for the valve of the lower one of the reservoirs so that upon operation of the flushing lever, the liquid is drained from the annular space into the lower one of the reservoirs. The vessel is removed and inverted for another cycle of play.

11 Claims, 1 Drawing Sheet

SIMULATED TOY COMMODE

BACKGROUND OF THE INVENTION

1. Field of the Invention

This invention relates generally to toys involving the simulated transfer of liquid and more particularly to a simulated toy commode or potty for dolls.

2. Background Art

Toys providing for simulated transfer of liquid have been popular playthings and have been particularly associated with feeding and the preparation of food. For example, there have long been baby bottles in which milk, formula, juice or the like appears to be transferred from the feeding bottle into a baby doll. Such prior art baby bottles have used clear, spaced apart, generally cylindrical walls, between which a liquid is contained. As the bottle is tipped over to simulate feeding of a doll or the like, the liquid passes from between the spaced apart walls into an opaque reservoir in the feeding nipple. Although only a relatively small amount of liquid is contained between the spaced apart clear walls, the impression is created that the entire bottle is full of liquid. Thus, a relatively small opaque reservoir, such as the nipple, may contain the entirety of the liquid to give the further impression that a larger volume of liquid has been emptied from the bottle and into the doll.

Simulated kitchen appliances using the same basic principle as the baby feeding bottles have also been popular playthings. For example, simulated coffee pots contain a brown colored liquid to represent coffee. The liquid contained between the spaced apart clear cylindrical walls flows into an opaque spout when the pot is tipped over and is there hidden to create the impression that the simulated coffee has been poured out of the pot and into a cup. For the most part, the simulated baby feeding bottles and the simulated kitchen appliances depend solely upon manual inversion of the toy to effect the transfer of the liquid from between the spaced apart clear walls into the opaque reservoir and do not employ any valves. However, a Fisher-Price automatic drip coffee pot did use a valve gravity biased to a closed position with the drip coffee maker in its normal upright position. By tipping over the coffee maker, the liquid is transferred from between the spaced apart clear plastic walls of a simulated glass pot into an upper opaque part simulating the portion of a drip coffee maker in which the filter and coffee grounds are contained. Pushing a start button opens the valve and the liquid is released from the reservoir back down between the spaced apart clear cylindrical walls to simulate the drip brewing of coffee and subsequent filling up of the simulated glass pot.

While the simulated feeding of dolls is a popular play pattern, there is also a lot of play relating to the simulated elimination of waste by dolls. To this extent there are many prior art dolls that "wet" and the like. However, there remains a need for a doll waste elimination toy that can be used with virtually any doll and does not require any special mechanism associated with the doll.

SUMMARY OF THE INVENTION

The present invention is concerned with providing a simulated toy commode that does not require the use of any special doll in order to simulate the doll urinating into the commode or potty and the subsequent flushing away of the urine. A potty vessel having a pair of spaced apart clear walls disposed between two opaque reservoirs contains a volume of liquid that may be selectively contained in any one of the reservoirs or in the annular space between the clear walls which is in controlled fluid communication with each of the reservoirs. The potty vessel is removeably positionable in a simulated commode housing which facilitates selective control of a valve between each of the reservoirs and the annular space to simulate passage of urine from a doll seated upon a commode into the potty vessel and the subsequent flushing elimination of the urine from the potty vessel. In one embodiment, the valves include a moveable magnetic material member.

BRIEF DESCRIPTION OF THE DRAWINGS

For a better understanding of the present invention, reference may be had to the accompanying drawings in which.

DETAILED DESCRIPTION

Figure 1:
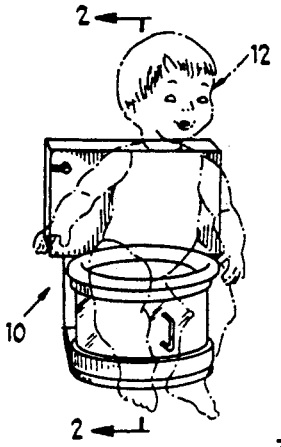
FIG. 1 is a perspective view of a simulated toy commode embodying the present invention with a doll seated upon the commode.

Referring now to the drawings in which like parts are designated by like reference numerals throughout the several views, FIG. 1 shows simulated toy commode 10 upon which a doll 12 of any conventional manufacture, is seated. Toy commode 10 includes a housing 14 having a generally horizontally disposed base 16. Extending upwardly from the rearward edge of base 16 is a generally vertically disposed hollow standard 18 at the upper portion of which is a simulated flush tank 20 including a pivoting flushing lever 22. Atop base 16 is a mounting pedestal 26 from the top of which projects a generally laterally centrally disposed key 28 that is proximate the front of pedestal 26

Figure 3:
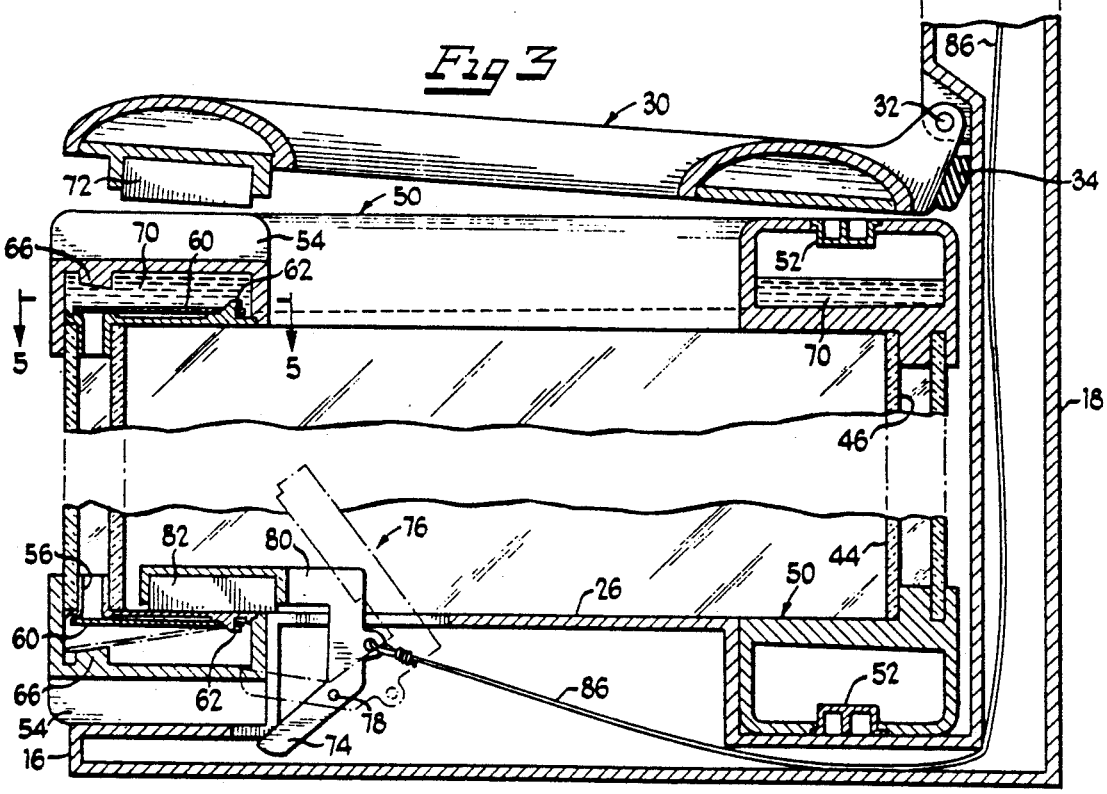
FIG. 3 is an enlarged scale sectional view taken generally along line 2—2 of FIG. 1.

Hingedly mounted to vertical standard 18, proximate the lower edge of tank 20 is a seat 30. As is best shown in FIG. 3, seat 30 is hinged for pivotal movement about the axis of a pintel 32. Along the rearward edge of seat 30 is a foam rubber pad 34 of a configuration and resiliency designed to bias seat 30 away from its lowermost position.

Figure 2:
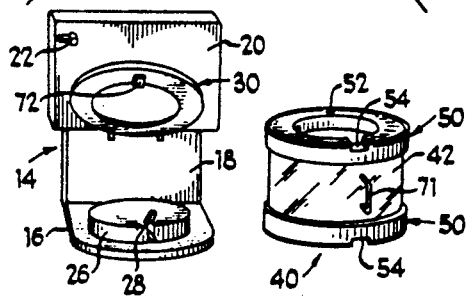
FIG. 2 is a perspective view of the simulated toy commode shown in FIG. 1 but with the vessel removed from the housing.

Also shown in FIGS. 2 and 3 is a removeable, invertable vessel 40 having a central portion formed by two spaced apart, clear plastic cylinders 42 and 44 which define an annular space 46 of a predetermined volume between them. At each of the opposed ends of the cylindrical walls 42 and 44, and hence at the opposed ends of annular space 46, is an annular reservoir 50. Each of the annular reservoirs 50 are identical in construction and have a reservoir volume equal to or greater than the volume of annular space 46.

Although, only actually required in one of the annular reservoirs, each reservoir 50 is, for ease of manufacture, provided with a fill opening and plug 52. In addition, each of annular reservoirs 50 is provided with a recessed area 54. In assembly of annular reservoirs 50 at each end of annular space 46, the respective recesses 54 are aligned with respect to each other. The interior of each of reservoirs 50 is in controlled fluid communication with annular space 46 through a valve opening 56.

Figure 4:
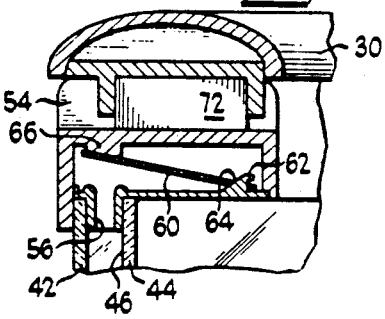
FIG. 4 is a fragmentary sectional view showing the hinged seat moved down into proximity with the vessel.
Figure 5:
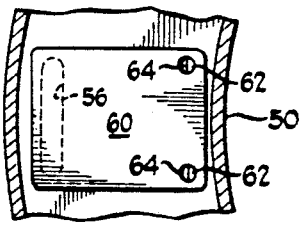
FIG. 5 is a sectional view taken generally along line 5—5 of FIG. 3.
Figure 5:
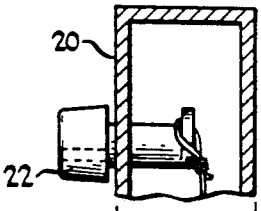

In the embodiment shown in FIGS. 3, 4 and 5, a pivoting moveable magnetic material member 60, preferably a magnetic stainless steel, is mounted within the reservoir to open and close valve opening 56. Member 60 is mounted on loose fitting round posts 62 having a chamfer 64 on the side facing opening 56. Accordingly, member 60 may pivot away from sealing engagement of valve opening 56 as is illustrated in FIG. 4 and in broken line for the lower reservoir in FIG. 3. Moveable member 60 is prevented from pivoting all the way off of posts 62 by a downward projection 66 on the inside of the reservoir.

A volume of liquid 70, which is conveniently colored to represent urine, is sealed in vessel 40. The volume of liquid 70 is equal to or less than the volume of annular space 46. Accordingly, the entire volume of liquid may be selectively contained in any one of annular space 46 or annular reservoirs 50.

Vessel 40 is removeable receivable on housing 14 in either of two inverted positions, that is with either of the reservoirs 40 in an upper position and the other reservoir in a lower position. Pedestal 26 facilitates centering of vessel 40 on housing 14 and recess 54 of the lower one of reservoirs 50 cooperates with key 28 to angularly orient vessel 40 with respect to housing 14. Both to facilitate handling of vessel 40 and to provide a guide for angularly orienting vessel with respect to housing 14 a handle 71 may be provided.

Generally centrally laterally disposed adjacent the front of seat 30, on the underside of the seat, is a valve actuator 72. With vessel 40 properly received in housing 14 and seat 30 moved to its lowermost position, valve actuator 72 operates the valve associated with the one of reservoirs 50 that is in the upper position to effect fluid transfer of liquid 70 from the reservoir to annular space 46. In the embodiment shown in FIGS. 3, 4 and 5, valve actuator 72 is a magnet that is positioned in recess 54 within a predetermined distance of moveable magnetic member 60 when seat 30 is moved to its lowermost position. The bias of foam rubber pad 34 keeping seat 30 away from its lowermost position is overcome by manual pressure or placing a doll of sufficient weight upon seat 30.

Before vessel 40 is placed on housing 14, liquid 70 is in the upper one of reservoirs 50 and moveable magnetic member 60 of the upper housing is in its downward valve closed state retaining liquid 70 in the upper reservoir. At the same time, moveable magnetic member 60 in the lower reservoir 50 is initially in its valve open state as a result of gravity. However, upon placing vessel 40 on housing 14, the lower reservoir engages key 28. In this embodiment, key 28 includes a projecting arm 74 of a bell crank 76 mounted for pivotal movement about the axis of a pin 78 carried within pedestal 26, as shown in FIG. 3. Bell crank 76 or more particularly arm 80, which is disposed on the opposite side of pivot 78 from arm 74, carries a magnet 82. With vessel 40 properly received on housing 14, bell crank 76 is in the position shown in solid line in FIG. 3 with magnet 82 positioned within a predetermined distance of moveable magnetic member 60 so as to magnetically engage member 60. Magnet 82 then moves member 60 to the valve closed state shown in solid line in FIG. 3 to prevent fluid transfer of liquid 70 from annular space 46 into the lower one of reservoirs 50.

A flexible strip 86 is connected at one end to bell crank 76 and at the other end to flushing lever 22. Accordingly, as flushing lever 22 is rotated downwardly, flexible strip 86 will be put in tension causing bell crank 76 to pivot about the axis of pin 78 to the position shown in broken line in FIG. 3. With bell crank 76 moved to the position shown in broken line in FIG. 3, magnet 82 will be moved away from member 60. As magnet 82 is moved away, gravity, together with the force of any liquid contained in annular space 46, will move magnetic member 60 to the valve open state illustrated in broken line in FIG. 3 permitting fluid transfer of liquid 70 from annular space 46 into the lower one of reservoirs 50 to simulate flushing of the potty vessel. After vessel 40 is "flushed," it may be removed from housing 14, inverted and then replaced on the housing for another play cycle.

Figure 6:
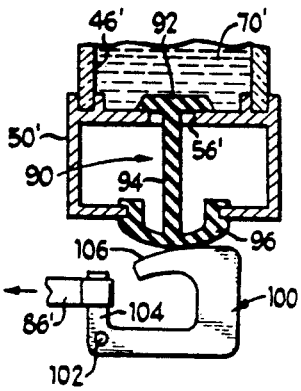
FIG. 6 is a fragmentary sectional view showing an alternative valve assembly and a flushing actuator for the valve.

An alternative valve embodiment and flushing valve actuator is shown in FIG. 6. A vessel for the embodiment of FIG. 6 is substantially identical to vessel 40 and includes an annular space 46' in controlled fluid communication with a reservoir 50' through a valve opening 56'. Mounted in reservoir 50' is a valve member 90 including a plate 92 disposed outside of reservoir 50' on the annular space side of reservoir 50'. Plate 92 is moveable between an opened state in which plate 92 is spaced from opening 56' and a closed state in which plate 92 seals opening 56'. Integrally formed with plate 92 is a relatively rigid stem 94 which extends between plate 92 and a depressible button 96. When plate 92 is in sealing relationship with opening 56', depressible button 96 projects beyond reservoir 50' on the side opposite annular space 46, Button 96 is sufficiently flexible so that it may be pushed inwardly causing stem 94 to move inwardly and in turn move plate 92 away from opening 56 to allow fluid transfer of liquid 70' from annular space 46' through opening 56' into reservoir 50'.

Selective operation of valve 90 associated with the upper one of reservoirs 50' is accomplished with the hinged seat 30 shown in FIG. 3. When seat 30 is moved to its lowermost position actuator 72 will engage button 96 and push it inwardly. Of course, in this embodiment, it is not necessary that actuator 72 be a magnet.

Since in the embodiment shown in FIG. 6, valve 90 is normally biased to a closed state, it is not necessary that housing 14 include any mechanism for closing the valve of the lower reservoir. To operate valve 90 associated with the lower one of reservoirs 50' to effect fluid transfer of liquid 70, from annular space 46' into the lower reservoir, a bell crank 100 is carried by pedestal 26 for engaging valve 90. Bell crank 100 is mounted for pivotal movement about the axis of a pin 102 carried by the housing. As shown in FIG. 6, bell crank 100 is somewhat "G" shaped and arm 104 disposed on side of pivot pin 102 is connected to flexible strip 86' that is connected at its other end to flushing lever 22 as previously described with respect to flexible strip 86. Another arm 106 of bell crank 100, disposed on the other side of pin 102, is positioned beneath button 96 of valve 90. As strip 86' is put in tension, arm 106 will be pivoted upwardly to push button 96, stem 94 and plate 92 upwardly and inwardly toward annular space 46' to effect flushing of the potty vessel upon operation of flushing lever While particular embodiments of the present invention have been shown and described, further variations and modifications will occur to those skilled in the art. It is intended in the appended claims to cover all such variations and modifications as fall within the true spirit and scope of the present invention.

What is claimed as new and desired to be secured by Letters Patents is:

1. A simulated toy commode comprising in combination:

a vessel having spaced apart clear walls defining an annular space of a first predetermined volume;

the annular space having opposed ends;

a first annular reservoir mounted in fluid communication with one of the opposed ends of the annular space;

a second annular reservoir mounted in fluid communication with the other of the opposed ends of the annular space;

a first valve associated with the first reservoir for controlling fluid communication between the annular space and the first reservoir;

a second valve associated with the second reservoir for controlling fluid communication between the annular space and the second reservoir;

the first reservoir having a second predetermined volume equal to or greater than the first predetermined volume;

the second reservoir having a third predetermined volume equal to or greater than the first predetermined volume;

a volume of liquid less than or equal to the first predetermined volume contained in the vessel;

a housing removeably receiving the vessel with one of the first or second reservoirs in an upper position and the other of the first or second reservoirs in a lower position;

first means carried by the housing for selectively operating the one of the first or second valves associated with the reservoir in the upper position to effect fluid transfer of the liquid from the reservoir in the upper portion to the annular space;

means providing for closure of the one of the first or second valves associated with the reservoir in the lower position to prevent fluid transfer of the liquid from the annular space to the reservoir in the lower position; and second means carried by the housing for selectively operating the other of the first or second valves associated with the reservoir in the lower position to effect fluid transfer of the liquid from the annular space to the reservoir in the lower position.

2. The simulated toy commode of claim 1 in which the means providing for closure of the one of the first or second valves associated with the reservoir in the lower portion biases the valve to a closed state.

3. The simulated toy commode of claim 1 in which:

the valves include a moveable magnetic material member; and each of the first and second valve operating means include a respective magnet for moving the magnetic material member of each of the valves between one of an opened or closed state to the other state upon the magnets being positioned within a certain predetermined distance of the valves.

4. The simulated toy commode of claim 3 in which each of the first and second reservoirs includes a recess proximate the magnetic material member for positioning of either of the magnets.

5. The simulated toy commode of claim 4 in which the recesses cooperate with means carried by the housing for keying the vessel in a particular orientation with respect to the housing.

6. The simulated toy commode of claim 1 including means for keying the vessel in a particular orientation with respect to the housing.

7. The simulated toy commode of claim 1 including:

a seat carried by the housing for pivotal movement toward and away from the one of the first or second reservoirs in the upper position; and the first means for actuating the valve in the upper one of the first or second reservoirs being carried by the seat.

8. The simulated toy commode of claim 7 in which the seat is biased away from the one of the reservoirs in the upper position.

9. The simulated toy commode of claim 1 including:

a simulated flushing lever carried by the housing;

means engageable with the one of the first or second valves associated with the reservoir in the lower position; and means linking the flushing lever and the engageable means so that actuation of the flushing lever effects opening of the one valve to effect fluid transfer of the liquid from the annular space into reservoir in the lower position.

10. The simulated toy commode of claim 1 in which each of the first and second reservoirs are substantially opaque.

11. The simulated toy commode of claim 1 in which the second and third predetermined volumes are equal.

* * * * *

UNITED STATES PATENT AND TRADEMARK OFFICE

CERTIFICATE OF CORRECTION

PATENT NO. : 5,252,101

DATED : October 12, 1993

INVENTOR(S) : Donald A. Rosenwinkel and Richard B. Kuralt

It is certified that error appears in the above-indentified patent and that said Letters Patent is hereby corrected as shown below:

| | |
|---|---|
| Col. 4, line 36 | After "46", delete "," and insert instead -- '. --. |
| Col. 4, line 52 | After "70", delete "," and insert instead -- ' --. |
| Col. 4, line 66 | After "lever", insert -- 22. --. |

Signed and Sealed this

Tenth Day of May, 1994

Bruce Lehman

*Attest:*

BRUCE LEHMAN

*Attesting Officer*

*Commissioner of Patents and Trademarks*